US010766164B2

(12) United States Patent
Philipp et al.

(10) Patent No.: US 10,766,164 B2
(45) Date of Patent: Sep. 8, 2020

(54) CHAMBER

(71) Applicants: PHYTOSANITATION VACUUM SYSTEMS LLC, Blacksburg, VA (US); WELKER VAKUUM GMBH, Neustadt an der Weinstrasse (DE)

(72) Inventors: Peter R. Philipp, Charlotte, NC (US); Claus Koch, Neustadt an der Weinstrasse (DE)

(73) Assignees: Phytosanitation Vacuum Systems LLC, Blacksburg, VA (US); Welker Vakkum GmbH, Neustadt an der Weinstrasse (DE)

( * ) Notice: Subject to any disclaimer, the term of this patent is extended or adjusted under 35 U.S.C. 154(b) by 161 days.

(21) Appl. No.: 16/108,898

(22) Filed: Aug. 22, 2018

(65) Prior Publication Data

US 2019/0381689 A1 Dec. 19, 2019

(30) Foreign Application Priority Data

Jun. 15, 2018 (DE) ..... 10 2018 114 359

(51) Int. Cl.
*F26B 5/04* (2006.01)
*B27K 5/00* (2006.01)
*B65D 88/74* (2006.01)

(52) U.S. Cl.
CPC ..... *B27K 5/0075* (2013.01); *B65D 88/74* (2013.01); *B27K 5/001* (2013.01); *B65D 2588/746* (2013.01); *F26B 2210/16* (2013.01)

(58) Field of Classification Search
CPC ..... B27K 5/0075; B65D 88/00; B65D 88/74; B65D 88/121; B65D 88/129; B65D 2588/00; B65D 2588/02; B65D 2588/746; F26B 2210/16; F26B 21/05
USPC ..... 34/407, 406, 443, 202, 201, 236
See application file for complete search history.

(56) References Cited

U.S. PATENT DOCUMENTS

| | | | | |
|---|---|---|---|---|
| 1,672,326 | A | 6/1928 | Kobiolke | |
| 2,802,281 | A | 8/1957 | Stone | |
| 7,908,791 | B1 | 3/2011 | Brash | |
| 2006/0016095 | A1* | 1/2006 | Gibbs | F26B 21/08 34/389 |
| 2006/0064993 | A1* | 3/2006 | Tofflemire | B60H 1/00014 62/132 |
| 2008/0066340 | A1* | 3/2008 | Kakuno | F26B 5/04 34/489 |

(Continued)

FOREIGN PATENT DOCUMENTS

WO 2011053171 A1 5/2011

*Primary Examiner* — John P McCormack
(74) *Attorney, Agent, or Firm* — Hudak, Shunk & Farine Co. LPA

(57) ABSTRACT

A system and its use for treatment of freight in a vacuum, having a chamber 1 for receiving a loaded container 9 having an external length CLa, an external width CBa and an external height CHa, wherein the chamber 1 has two side walls 11, 12 arranged opposite to a bottom 13 and top 14 and arranged opposite to a front wall 15 and back wall 16, and wherein a direction system XYZ is at right angles; and a conveying element 2 for parking and moving a container 9 relative to chamber 1 from a first position P1 outside the chamber 1 into a second position P2 inside the chamber 1; and a driving device 8 for moving between the first position P1 and the second position P2.

15 Claims, 4 Drawing Sheets

(56) References Cited

U.S. PATENT DOCUMENTS

| | | | | |
|---|---|---|---|---|
| 2009/0293524 | A1* | 12/2009 | Vezina | B65D 88/744<br>62/239 |
| 2010/0045093 | A1* | 2/2010 | Foisie | B60P 1/045<br>298/17 S |
| 2012/0160835 | A1* | 6/2012 | Kimrey, Jr. | F26B 3/347<br>219/690 |
| 2014/0133952 | A1* | 5/2014 | Carling | B65D 88/12<br>414/800 |
| 2015/0368052 | A1* | 12/2015 | Sheesley | B65D 88/129<br>414/414 |
| 2016/0229079 | A1* | 8/2016 | Chute | A61L 2/04 |
| 2016/0340111 | A1* | 11/2016 | DiSorbo | B60P 1/52 |
| 2019/0161277 | A1* | 5/2019 | Pap | A23B 9/08 |

* cited by examiner

CHAMBER

FIELD OF THE INVENTION

The invention relates to a system for treating freight in a vacuum, comprising a chamber for receiving the freight.

BACKGROUND OF THE INVENTION

A system for treating freight in a vacuum is already known from U.S. Pat. No. 1,672,326, in which freight in the form of trunk wood is loaded onto a transport cart which is pushed into the chamber, in order to load a vacuum chamber. In addition, the concept of connecting a treatment chamber, which is used to chemically treat wood in the container, to an ISO container is known from U.S. Pat. No. 7,908,791 B1.

SUMMARY OF THE INVENTION

The object which forms the basis of the invention is to configure and arrange a system in such a manner that a rapid and, at the same time, simple loading and unloading of the chamber is achieved for a treatment in a vacuum.

The object is achieved according to the invention in that the chamber is configured to receive a loaded container having an external length, an external width and an external height, wherein the chamber has two side walls and a top arranged opposite a bottom as well as a back wall arranged opposite a front wall. In addition, the system comprises a conveying element for putting down and for moving a container relative to the chamber from a first position outside the chamber into a second position in the chamber, and a driving device for moving between the first position and the second position.

The result of this is that in order to treat the freight contained in a container with a negative pressure, the freight does not have to be transferred from the container to a transport device, but the freight can be introduced together with the opened container into the chamber. A further advantage is the fact that the container is treated at the same time as the freight such that the container and, in particular, the bottom of the container consisting of wood are also sterile and/or germ-free and the freight can be further transported under optimum conditions. There is no possibility of contaminating the freight again by transferring it again.

The term 'containers' within the framework of the invention denotes so-called ISO containers or so-called flat track containers, which are standardized large-capacity containers (freight containers) made of steel, which make it possible to load, convey, store and unload goods simply and quickly. The containers differ in their lengths, widths and heights. A distinction is essentially made between containers having an external length of approx. 6 meters (20 feet), approx. 12 meters (40 feet), approx. 13 meters (45 feet) and approx. 16 meters (53 feet) as well as an external height of approx. 2.6 meters (8'6") and approx. 2.9 meters (9'6"). Likewise, the term 'containers' is used to describe all immobile devices and units, on which and in which general cargo can be stored. The dimensions of the respective container only matter within the framework of the invention, inasmuch as the chamber has sufficiently large internal dimensions for the respective container and the driving device is suitable for moving the respective container.

The chamber preferably has two side walls which are arranged parallel to one another and, in each case, at right angles to a Y-direction and a top which is arranged parallel to a bottom having the respective alignment at right angles to a Z-direction as well as a back wall which is arranged parallel to a front wall with the respective alignment at right angles to a X-direction, wherein the direction system XYZ is at right angles.

In particular, it can be advantageous if the conveying element has a platform for putting down a container and a wheel or roller system for moving the platform relative to the chamber from a first position outside the chamber into a second position in the chamber. Here, the driving device serves to move the platform between the first position and the second position. The platform simultaneously provides an opportunity of working on the container, in order to prepare for the treatment; in particular the opening and fixing of the container doors, the installation of hoses in the container and the placement of sensors in the freight. Thanks to the platform, it is possible to work both outside the chamber and in the chamber.

To this end, it can also be advantageous if there is provided directly connected to the chamber a module having a vacuum pump as well as a regulating and control system and a conduit system, with which a vacuum of up to 98% or a pressure of less than 100 mbar absolute can be produced in the chamber. An absolute pressure of, by way of example, 100 mbar is equivalent to 900 mbar negative pressure, i.e. 900 mbar less pressure than ambient or normal pressure of approx. 1000 mbar, which corresponds to the average atmospheric pressure. Such pressure conditions cannot be produced in a container due to the design of generic containers.

It can also be advantageous if a steam generator is additionally provided, with which saturated steam can be produced in a temperature range between 20° C. and 60° C. in the chamber. Saturated steam between 20 degrees Celsius (° C.) and 60° C. is achieved at an absolute pressure of between approx. 25 mbar and approx. 200 mbar, which is why the container (9) itself is not mechanically suitable for performing such a method.

In technology and the natural sciences water vapor is the designation for water in the gaseous state of aggregation. This is invisible like air but it is not called water gas since this term has a different meaning. If water vapor flows into a colder environment, parts of the gaseous water condense to form the finest droplets. Such a mixture of water vapor and droplets is referred to as wet steam which can be observed, for example, when boiling water. Hot steam is water vapor with a temperature above the boiling temperature. The hot steam is "dry" and does not contain any droplets and is also not visible. The threshold between wet and hot steam is called "saturated steam" or dry saturated steam or also "dry steam". Most of the tabular values regarding water vapor states are related to this.

It is additionally particularly advantageous, if the chamber internally has a length of at least 8.4 m or at least 27'6" (27 feet 6 inches), width of at least 2.4 m or at least 8'0", height of at least 2.5 m or at least 8'6" or length of at least 6.0 m or at least 19'10", width of a maximum of 2.6 m or at least 8'7", height of at least 2.5 m or at least 8'6".

According to the invention, there are in principle two possible ways of introducing an opened container into the chamber. Either at least one or both container doors are swung back as far as possible, in each case, by approx. 270 degrees (°) from the closed position or at least one or both container doors are, in each case, only opened by a maximum of 110° starting from the closed position. The advantage of the first variant is that both the platform and the chamber can be designed to be shorter by the dimension of the width of a container door than in the case of the second variant, because the container door does not protrude in the longitudinal direction of the container. The advantage of the second variant compared with the first variant is that the internal width of the chamber can be reduced to slightly more than the dimension of the external width of the container, because the container door is not positioned next to the container. This is because, in the case of the first variant, the width of the container increases by the dimension of the thickness of at least one door. If both doors are opened for the treatment, the width increases accordingly by double the dimension of the thickness of the container doors.

In this case, it can advantageously be provided that a pitch for a container in the chamber is defined by the second position in the chamber, wherein in the X-direction in front of and/or behind the pitch at least one connecting sleeve for connecting at least one hose for conducting air and steam is provided on at least one side wall. Such hoses are installed inside the container between the freight such that, during the treatment with steam, the steam can be distributed in the container as quickly as possible and efficiently.

It can be particularly important for the present invention if the chamber has a front door and/or a rear door for loading and/or unloading a container. The simplest variant of a chamber only comprises a front door. Such a system does not allow a second container to be prepared for the treatment directly in front of the chamber, because the pitch in front of the chamber is required to guide the first container out of the chamber following the treatment. A chamber having two doors makes it possible to proceed in two possible ways: either the containers are only guided into the chamber in the manner of a one-way street system from one side and guided out of the opposite side of the chamber, or the containers are prepared on both sides of the chamber and are alternately guided into the chamber and out of the chamber from one side or the other.

In connection with the configuration and arrangement according to the invention, it can be advantageous if the platform has an angle of inclination $\alpha$ of at least 1.0° to 1.5°, at least in the second position. One first possibility according to the invention for achieving this consists of designing the bottom of the chamber with a corresponding gradient of at least 1.0° to 1.5°. As a result, this makes it possible to allow the condensate accruing in the container during the treatment to deliberately flow out of the container in one direction, and to collect it at a position inside the chamber and guide it out of the chamber.

Alternatively, it can be advantageous if means are provided on the platform in order to raise the platform on one side at one end of the platform and/or to raise a container on one side at one end of the container or at both ends of the container. This alternative to a bottom of the chamber having a gradient additionally offers the possibility of adjusting the inclination of the container to the volume flow of the condensate. Likewise, this offers the possibility of adapting the gradient to the side at which the container is opened.

Moreover, it can be advantageous if one access opening which can be locked with a door or with a flap is provided at least in one side wall in the chamber. In particular, in the case of chambers in which two or more containers are accommodated for treatment, such separate flaps allow access between the containers. According to the invention, it is envisaged for the treatment of, in particular, trunk wood that the steam be guided via multiple hoses inside the chamber into the container, in particular if the containers are only opened on one side for treatment. The corresponding connecting sleeves for connecting the hoses are provided in the case of the system according to the invention in the areas between the containers on the side walls of the chamber.

It can additionally be advantageous if the platform is longer by at least the dimension of the width of a container door than the length of the container and, as a result, has a working area for one person. In the case of the second variant described above, in which the container door is only opened by a maximum of 110°, this offers the possibility of carrying out work directly on the opened container such as, by way of example, installing hoses or placing sensing elements inside the container, irrespective of the position of the platform and therefore independently of the position of the container. In this case, the working area has an at least partially accessible work space.

Furthermore, it can be advantageous if a device for fixing doors of a container is arranged on the platform. As a result, this creates the possibility for the second variant described above, in which the container door is only opened by a maximum of 110°, of achieving a defined position of the container door. Such a device is also provided for the variant in which the container doors are completely opened.

To this end, it can also be advantageous if the internal upper side of the bottom is at least partially inclined, and/or the bottom has channels, in such a manner that condensate can collect in at least one central location in the chamber. As a result, the condensate flowing out of the container can be collected at a central location inside the chamber and can be guided out of the chamber. As a result, the solids contents accruing during the treatment can also be collected centrally. Moreover, all of the rinsing water and the solid particles likewise accruing during cleaning of the chamber can be collected centrally and guided out of the chamber.

Finally, it can be advantageous if a suction device for extracting condensate and/or for catching solid parts is provided. This therefore further simplifies the cleaning of the chamber.

BRIEF DESCRIPTION OF THE DRAWINGS

Further advantages and details of the invention are explained in the patent claims and in the description and represented in the figures, wherein:

DETAILED DESCRIPTION OF THE INVENTION

Figures 1, 2, 3:
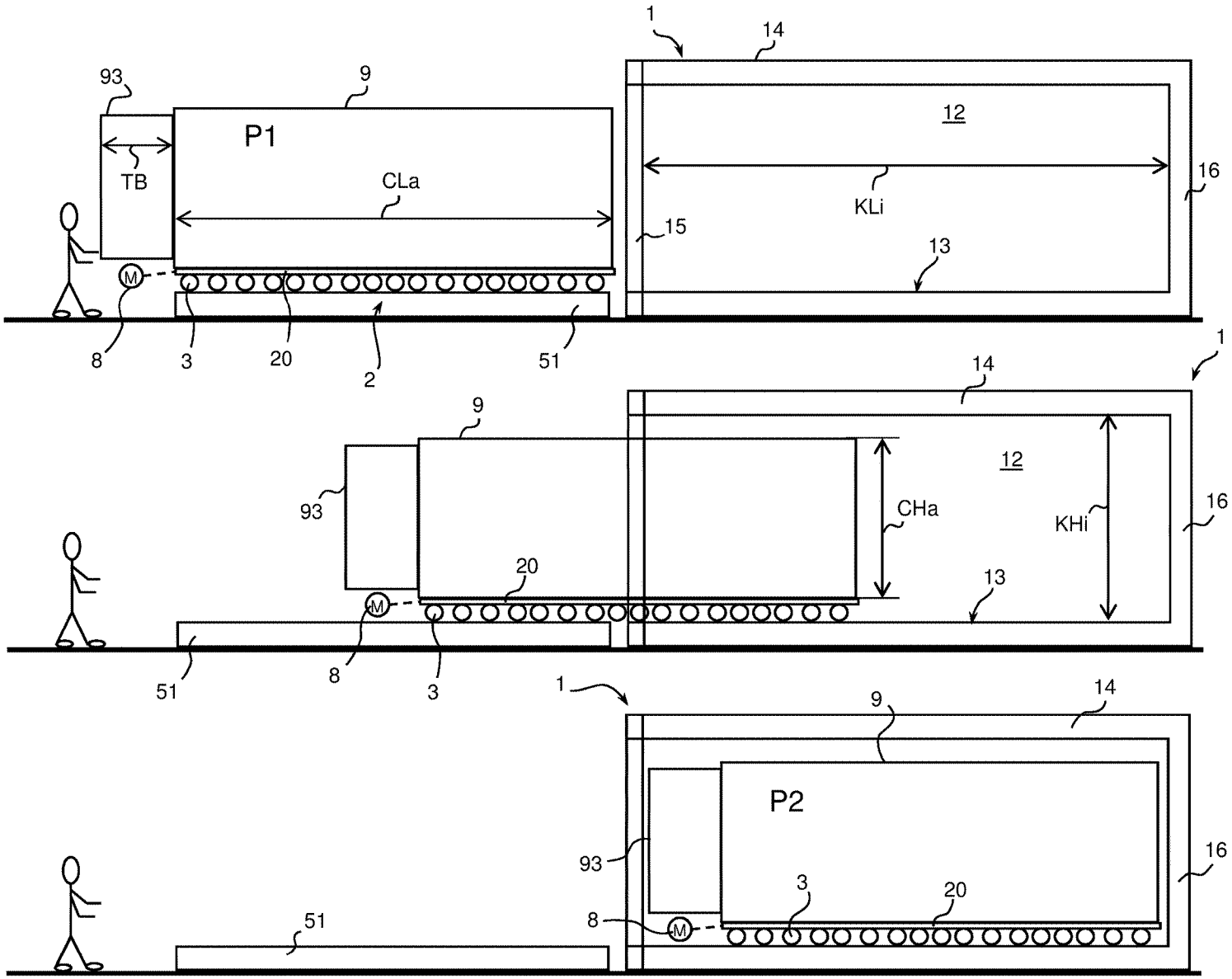
FIG. 1 shows a perspective side view of a chamber opened on one side and of a container opened on one side on a platform in a first position.
FIG. 2 shows a representation according to FIG. 1 in an intermediate position.
FIG. 3 shows a representation according to FIG. 1 in a second position of the container.

An ISO container is used in the embodiment examples described. The system described would also be suitable for any other container having similar dimensions, insofar as they are technically viable.

The basic elements of a system for treating freight stored in an ISO container are, in each case, represented in FIGS. 1-9. The system comprises a chamber 1 for receiving a loaded ISO container 9 having an external length CLa, an external width CBa and an external height CHa of the container 9. The chamber 1 itself has two side walls 11, 12 and a top 14 arranged opposite a bottom 13 as well as a back wall 16 arranged opposite a front wall 15. The chamber 1 can be hermetically sealed and designed for producing a vacuum down to less than 100 mbar absolute internal pressure. The internal dimensions of the chamber 1, namely the internal length KLi thereof, as well as the internal height KHi and the internal width KBi thereof are dimensioned in such a manner that a corresponding ISO container can be accommodated therein.

In these embodiment examples, the side walls 11, 12 are arranged parallel to one another and, in each case, at right angles to a Y-direction. The bottom 13 is arranged parallel to the top 14 with the respective alignment at right angles to a Z-direction and the front wall 15 is arranged parallel to the back wall 16 with the respective alignment at right angles to a X-direction, wherein the direction system XYZ is at right angles.

The system additionally comprises a conveying element 2 for putting down and for moving a container 9 relative to the chamber 1 from a first position P1 outside the chamber 1 into a second position P2 inside the chamber 1, and a driving device 8 for moving the container 9 between the first position P1 and the second position P2.

Figure 4:
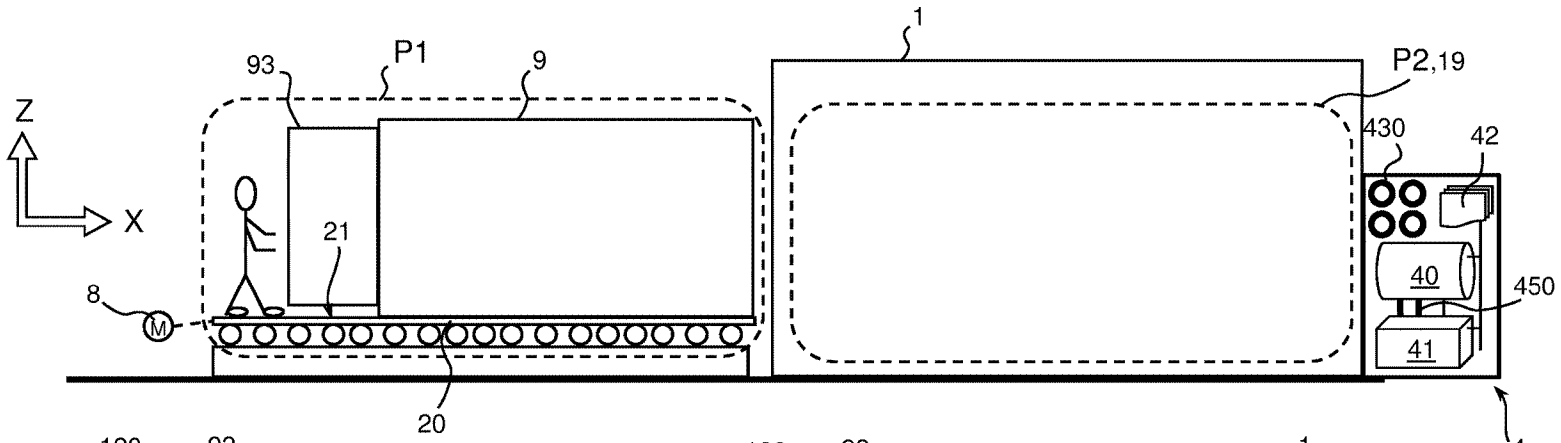
FIG. 4 shows a perspective side view of a container on a platform with a working area and a chamber opened on one side.

The conveying element 2 comprises, in this special configuration, a platform 20, on which the container 9 is put down as well as a roller system 3, with the aid of which the platform 20 can be moved substantially horizontally in the X-direction. Prior to the treatment of the freight, which is not represented in more detail and which is contained inside the container 9, the container is put down in front of the chamber 1 on the platform 20 and at least one container door 93 is opened (FIGS. 1, 4 and 6). According to FIG. 2, the container 9 is located in an intermediate position and is moved with the aid of the driving device 8 into the chamber 1. In front of the chamber 1, a podium 51 is provided which is substantially the same height as the bottom 13 in the chamber 1, such that the freight is substantially transported horizontally. According to FIGS. 3, 5 as well as 7 to 9, the container 9 is located in the position P2 in the chamber 1.

In the special cases represented in FIGS. 1-9, the chamber 1 has an internal length KLi which corresponds to the external length CLa of the container 9 plus the dimension of the width TB of the container door 93. Consequently, the chamber 1 does not have to be substantially wider internally than the external width CBa of the container 9, because the container doors 93 are not arranged between the container 9 and the side wall 11, 12 of the chamber 1.

Figure 7:
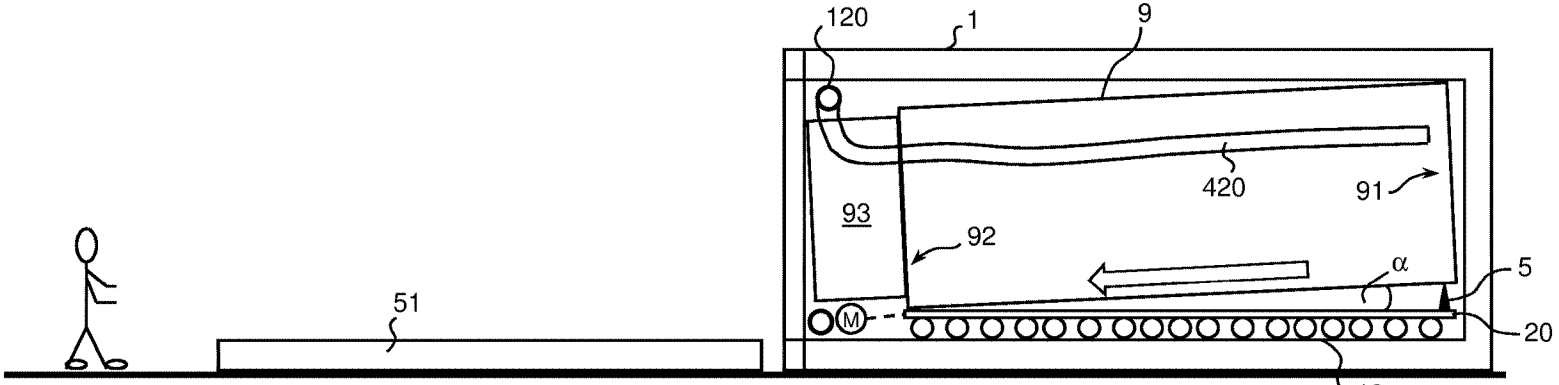
FIG. 7 shows a perspective side view of a container inclined with respect to the platform.

FIG. 4 illustrates the pitches 19 which the container 9 occupies in the position P1 in front of the chamber 1 and in the position P2 in the chamber 1. The position P2 in the chamber 1 is significant with respect to the further preparations for treating the freight in the container 9. In order to treat the freight, air is both sucked out of the chamber 1 by means of connecting sleeves 120, thus creating a vacuum, and air as well as, in particular, water vapor is introduced into the chamber 1. Hoses 420 are connected to the connecting sleeves 120 and installed inside the container 9 for the treatment of the freight (FIG. 7).

Figure 5:
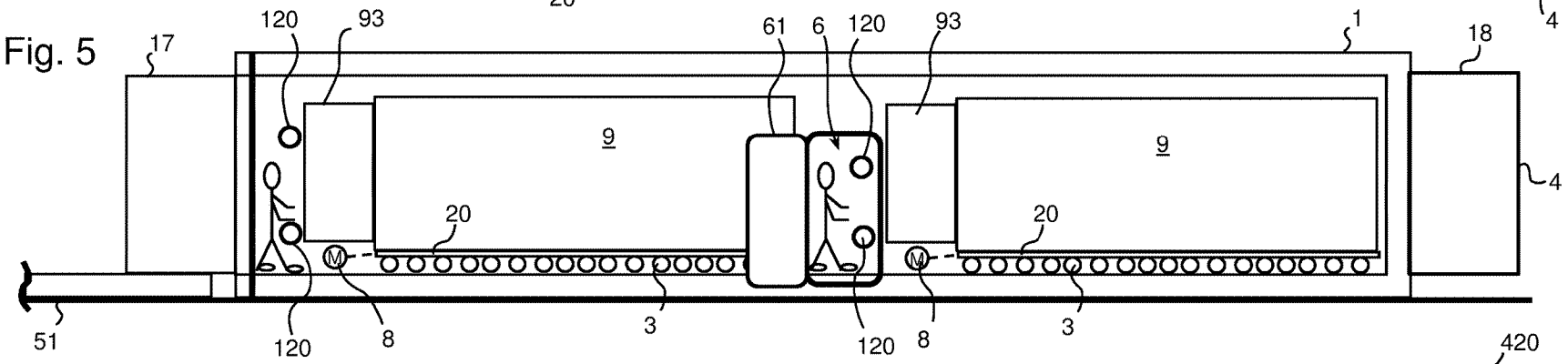
FIG. 5 shows a perspective side view of a chamber opened on two sides for two containers.
Figure 6:
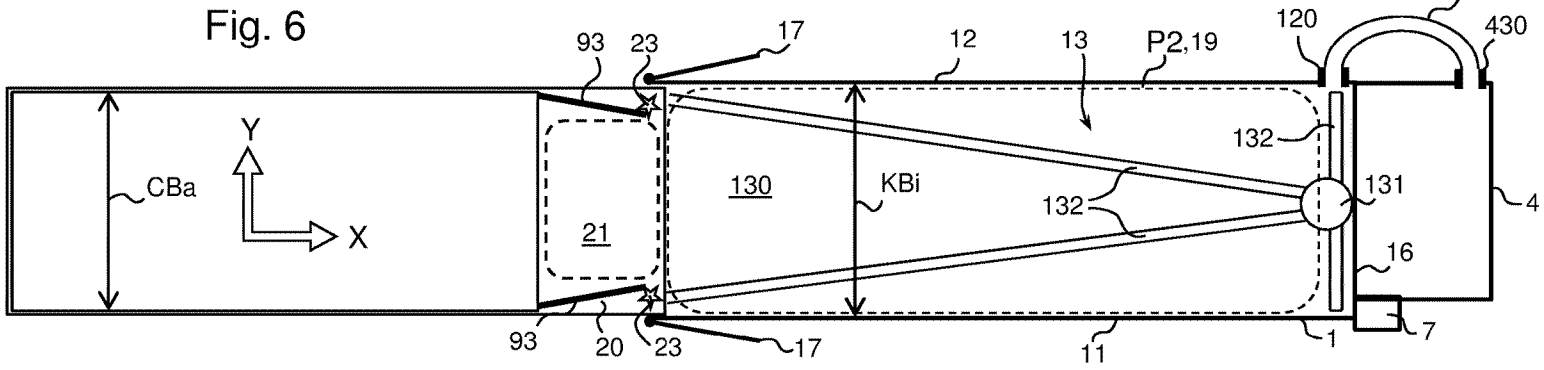
FIG. 6 shows a perspective top view of a chamber opened on one side with a container opened on one side and container doors fixed in a working area.

FIG. 5 illustrates that the chamber 1 can also receive multiple containers 9 at the same time. It is now envisaged that the chamber 1 has a front door 17 as well as a rear door 18. As a result, the chamber 1 can be loaded and unloaded with containers 9 from both sides. Sufficient space is available at least in front of each container 9 and between two containers 9, in order to work on the containers 9. Since the internal width KBi of the chamber 1 in this embodiment example virtually corresponds to the external width CBa of the container 9, it is not possible for the operating personnel to go between the containers 9 and the side walls 11, 12 of the chamber 1 and work. Access between the containers 9 is achieved by a separate access opening 6 in the side walls 11, 12 of the chamber 1, which can be sealed by means of a door 61.

In order to produce the vacuum and the necessary water vapor, the chamber 1 has a module 4 which comprises a vacuum pump 40, a steam generator 41 as well as a regulating and control system 42 and appropriate pipes 450. The connecting sleeves 120, via which the hoses 420 are connected in the interior of the chamber 1, are also used at the same time outside the chamber 1 to connect the module 4 by means of corresponding connecting sleeves 430 to the module 4 for the relevant supply.

The difference between the embodiment examples according to FIGS. 1-3 with respect to the embodiment examples according to FIGS. 4-6 is a platform 20 of a different length. According to FIGS. 4-6, the platform 20 is approx. 1.5 m longer than the container 9, so that a working area 9 is made available on the platform 20 in front of the container 24, in which working area the staff can work to a limited extent. At the same time, devices for fixing one or both container doors 93 are provided on the platform 20 in this extended area 23.

The doors 17 of the chamber 1 are completely opened in order to introduce the container 9 into the chamber 1. Channels 132 as well as a central location 131 are provided in the bottom 13 of the chamber 1 on the upper side 130, via which channels and central location the condensate and solid particles resulting during the treatment of the freight can be collected and guided out of the chamber 1. To this end, a suction device 7 is provided, which is connected to the channel system. The pitch 19 provided in the chamber 1 in the position P2 allows a certain free space between the container 9 and the back wall 16 of the chamber 1.

Figure 8:
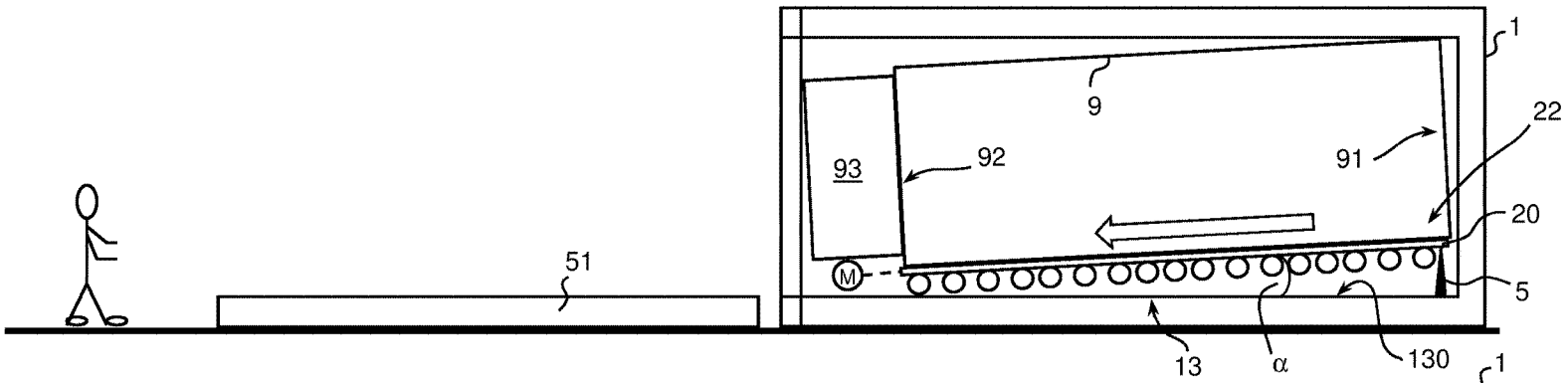
FIG. 8 shows a perspective side view of a platform inclined with respect to the bottom of the chamber.
Figure 9:
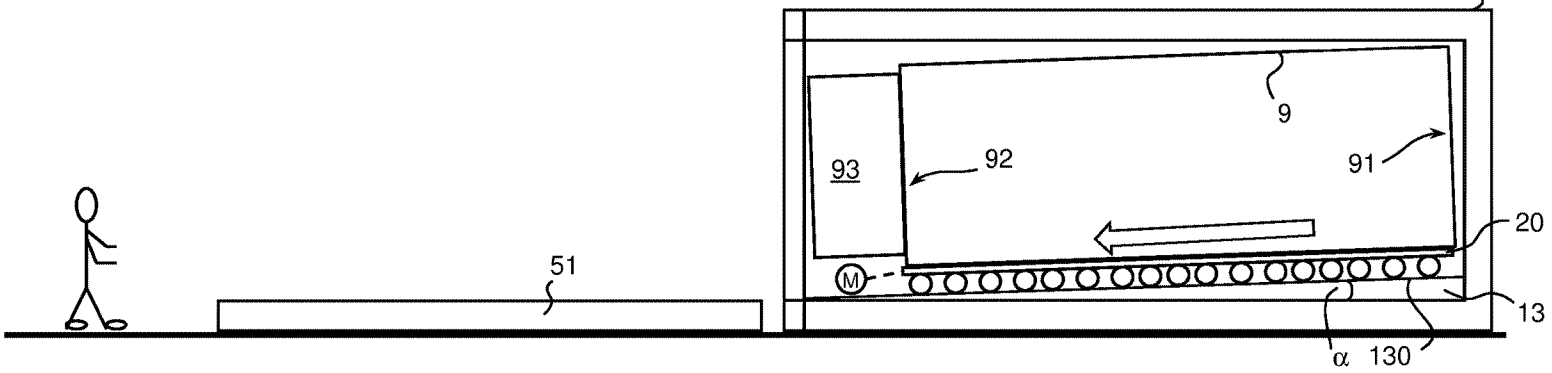
FIG. 9 shows a perspective side view of a chamber having a bottom with a gradient.

In order to specifically carry away the condensate and the solids from the container 9, it is envisaged that the container 9 be positioned in an inclined position inside the chamber 1. To this end, three examples are represented in FIGS. 7-9 for inclining the container 9 by an angle α. In accordance with the embodiment example according to FIG. 7, means 5 are provided on the conveying element 2, in order to raise the container 9 at one of the two ends 91, 92 so far that the container 9 has an inclination of between 1.5° and 2°. According to FIG. 8, means are provided on the conveying element 2 which are braced downwardly on the upper side 130 of the bottom 13 of the chamber 1 and consequently raise the conveying element 2 with the container 9 at one end 22 by a corresponding dimension. The solution represented in FIG. 9 shows a particular bottom 13 in the chamber 1, which has an upper side 130 with a corresponding gradient.

Figure 11A:
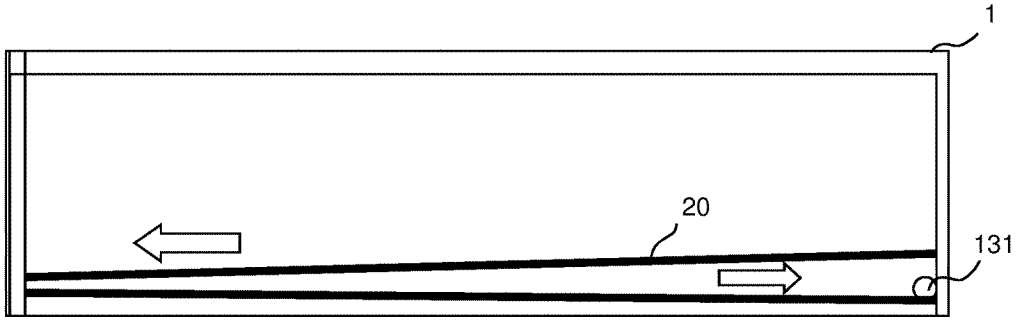
FIG. 11*a* shows a schematic sketch of the flow for the condensate.
Figure 11B:
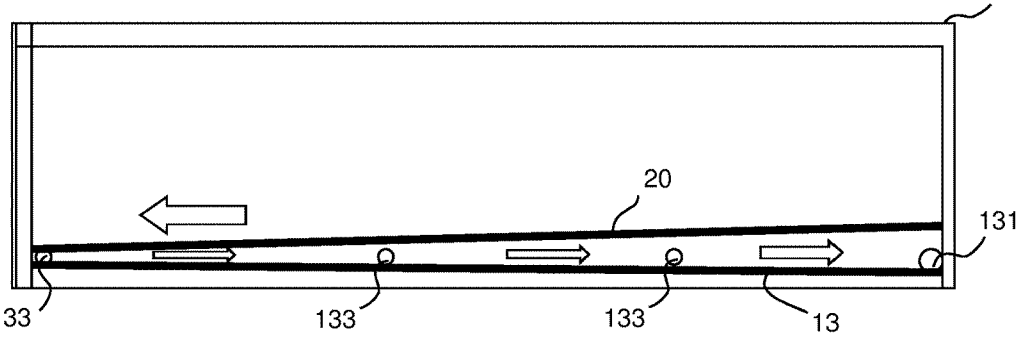
FIG. 11*b* shows a schematic sketch of the flow of waste water during or after cleaning.

The flow of the condensate inside the container 9 and in the chamber 1 is shown in principle in FIGS. 11*a* and 11*b*. The two oblique levels illustrate how the condensate is first carried off in the direction indicated with arrows above the bottom 13 of the chamber 1 in one direction and, after leaving the container 9, runs in the other direction to the central location 131. Multiple rinsing channels 133 are provided for cleaning and rinsing the chamber 1, by means of which rinsing channels fresh water and cleaning agents are introduced into the chamber 1 and which, together with the solid particles and the remaining condensate, are likewise guided by means of the channels 132 represented in greater detail in FIG. 6 to the central location 131.

Figure 10:
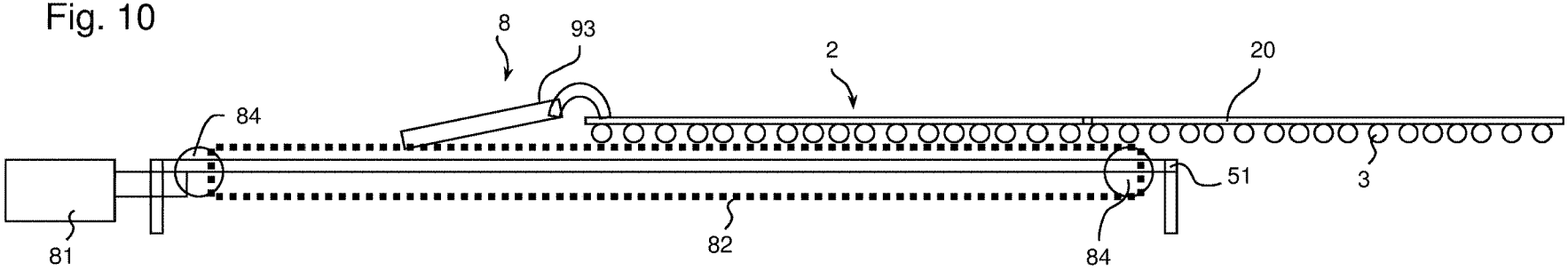
FIG. 10 shows a schematic sketch of a driving device.

A simple principle of a driving device 8 is represented in FIG. 10, with the aid of which the platform 20 can be transported with its roller system 3 from the podium 51 in a horizontal direction into the chamber 1 or out of the chamber 2. To this end, an anchor 83 is provided, which is positively connected to the platform 20 and which is driven in both horizontal directions by means of a conveyor chain 82 and two drive rollers 84 by means of the engine 81.

What is claimed is:

1. A system for treating freight in a vacuum, comprising:
   a) a chamber, configured for providing a treatment in a vacuum and configured to receive a loaded freight container having an external length, an external width and an external height, wherein the chamber has
      i) two side walls and
      ii) a top arranged opposite a bottom as well as
      iii) a back wall arranged opposite a front wall, and wherein the direction system XYZ is at right angles,
   b) a conveying element, wherein the conveying element has a platform for putting down the freight container and a wheel or roller system for moving the platform together with the freight container relative to the chamber from the first position outside the chamber into the second position in the chamber, and
   c) a driving device connected to the platform for moving the platform together with the freight container between the first position and the second position.

2. The system according to claim 1, wherein there is provided directly connected to the chamber a module having a vacuum pump as well as a regulating and control system and pipes, with which a vacuum of up to 98% or a pressure of less than 100 mbar absolute can be produced in the chamber.

3. The system according to claim 1, wherein a steam generator is additionally provided, with which saturated steam can be produced in a temperature range between 20° C. and 60° C. in the chamber.

4. The system according to claim 1, wherein the chamber internally has a
   a) length of at least 8.4 m (27 feet 6 inches),
   b) width of at least 2.4 m (8'0"),
   c) height of at least 2.5 m (8'6") or
   d) length of at least 6.0 m (19'10"),
   e) width of a maximum of 2.6 m (8'7"),
   f) height of at least 2.5 m (8'6").

5. The system according to claim 1, wherein the pitch for the freight container in the chamber is defined by the second position in the chamber, wherein in the X-direction in front of and/or behind the pitch at least one connecting sleeve for connecting at least one hose for conducting air and steam is provided on at least one side wall.

6. The system according to claim 1, wherein the chamber has a front door and/or a rear door for loading and/or unloading the freight container.

7. The system according to claim 1, wherein the platform has an angle of inclination $\alpha$ of at least 1.0°, at least in the second position.

8. The system according to claim 7, wherein means are provided on the platform in order to raise the platform on one side at one end of the platform and/or to raise the freight container on one side at one end of the freight container or at both ends of the freight container.

9. The system according to claim 1, wherein one access opening which can be locked with a door or with a flap is provided at least in one side wall in the chamber.

10. The system according to claim 1, wherein the platform is longer by at least the dimension of the width of a door of the freight container than the length of the freight container and, as a result, has a working area for one person.

11. The system according to claim 1, wherein a device for fixing doors of the freight container is arranged on the platform.

12. The system according to claim 1, wherein an internal upper side of the bottom is at least partially inclined, and/or the bottom has channels, in such a manner that condensate can collect in at least one central location in the chamber.

13. The system according to claim 1, wherein a suction device for extracting condensate and/or for catching solid parts is provided.

14. A method for treating trunk wood, comprising the steps of using the system according to claim 1 to create vacuum and/or steam, wherein the wood is stored in the freight container with an external length of at least 8.4 m and the wood is positioned in the chamber together with the freight container.

15. A method for treating trunk wood, wherein the trunk wood in a first step is stacked or stored the freight container with an external length of at least 8.4 m and in an indirectly or directly following further step is treated together with the freight container in a system for vacuum treatment according to claim 1.

* * * * *